US005723211A

United States Patent [19]

Romano et al.

[11] Patent Number: 5,723,211

[45] Date of Patent: Mar. 3, 1998

[54] INK-JET PRINTER RECORDING ELEMENT

[75] Inventors: Charles Eugene Romano, Rochester; Wayne Thomas Ferrar, Fairport; Jeanne Ellen Kaeding, Rochester, all of N.Y.

[73] Assignee: Eastman Kodak Company, Rochester, N.Y.

[21] Appl. No.: 625,980

[22] Filed: Apr. 1, 1996

[51] Int. Cl.[6] ..... B41M 5/00

[52] U.S. Cl. ..... 428/328; 428/195; 428/206; 428/329; 428/478.2; 428/480

[58] Field of Search ..... 428/195, 206, 428/478.2, 328, 329, 480

[56] References Cited

U.S. PATENT DOCUMENTS 5,264,275 11/1993 Misuda et al. ..... 428/195
5,418,078 5/1995 Desie et al. ..... 428/195

*Primary Examiner*—Pamela R. Schwartz
*Attorney, Agent, or Firm*—John R. Everett

[57] ABSTRACT

An image-recording element for an ink-jet printer comprising, in the following order:

(a) a substrate;

(b) a solvent-absorbing gelatin layer and (c) a single image-forming layer of porous, pseudo-boehmite having an average pore radius of 10 to 80 Å.

12 Claims, No Drawings

INK-JET PRINTER RECORDING ELEMENT

BACKGROUND OF THE INVENTION

The present invention relates generally to a recording element and, more particularly, the present invention relates to a recording element for an ink-jet printer having excellent ink-receiving properties.

DESCRIPTION OF THE RELATED ART

In a typical ink-jet recording or printing system, ink droplets are ejected from a nozzle at high speed towards a recording element or medium to produce an image on the medium. The ink droplets, or recording liquid, generally comprise a recording agent, such as a dye, and a large mount of solvent in order to prevent clogging of the nozzle. The solvent, or carrier liquid, typically is made up of water, an organic material such as a monohydric alcohol or a polyhydric alcohol or a mixed solvent of water and other water miscible solvents such as a monohydric alcohol or a polyhydric alcohol.

The recording elements or media typically comprise a substrate or a support material having on at least one surface thereof an ink-receiving or image-forming layer. The elements include those intended for reflection viewing, which usually have an opaque support, and those intended for viewing by transmitted light, which usually have a transparent support.

While a wide variety of different types of image-recording elements have been proposed heretofore, there are many unsolved problems in the art and many deficiencies in the known products which have severely limited their commercial usefulness. The requirements for an image-recording medium or element for ink-jet recording are very demanding. For example, the recording element must be capable of absorbing or receiving large amounts of ink applied to the image-forming surface of the element as rapidly as possible in order to prevent image bleeding, image puddling and to produce recorded images of high optical density.

Image bleeding is a phenomenon caused by poor ink receptivity. As the ink-jet printer applies small droplets of ink to the image-recording element in a selective pattern to form the images, the droplets are absorbed into the image-forming surface of the element to form dots. After initial absorption, the dye continues to spread laterally. While some post imaging spread is desirable to fill in the white areas between the dots so as to obtain good uniform coloration and image density, it is important that the ink not spread to such an extent that the edge of the imaged area loses its sharpness, or that one color "bleeds" into another.

Image puddling is a phenomenon caused by poor ink receptivity in which adjacent ink droplets coalesce into a sheet of liquid which tends to flow, particularly along the edges of solid fill areas of the image.

Ink receptivity is defined as the ability of the image-forming or ink-receiving layer of a recording element to rapidly absorb ink applied to the surface thereof so that a minimal amount of flow occurs beyond the immediate locale where the ink droplet is deposited.

Further, it is desirable that the image be waterfast so that it is not harmed by contact with water or other aqueous liquids that might come into contact with the image-recording element as a result of spills or other accidental exposure to liquids. The image-forming layer must also be waterfast to avoid removal of the image through dissolution or damage to the layer itself.

Still further, it is desirable that the image-recording element exhibit rapid drying characteristics so that images imparted to the image-forming layer dry quickly thereon. The drying time of a recorded image is generally a function of the rate of ink absorption by the recording element and is the time required for the printed image to dry to the point where the image will not transfer to another surface such as, for example, another sheet of paper, or as measured herein, the time required for the printed image to dry to the point where no color is observed on the tip of a cotton swab pressed firmly against the image and then removed. The transference of an image from one surface to another surface is often referred to in the art as "offset".

Image-recording elements having rapid drying characteristics are also important to prevent image-banding. Image-banding is a phenomenon caused by prolonged drying times in which variations in density of a given color appear as one or more horizontal bands of different shades of the same color in the solid fill areas of a printed image.

Unfortunately, no recording element or medium is known which satisfies all of the above requirements.

Single layer gelatin ink recording elements, as well as multi-layer ink recording elements containing gelatin layers, are known. It is expected that these elements would suffer from poor offset, poor smudge resistance and poor water fastness. Gelatin free recording elements comprising pseudo-boehmites layers are also known. However such elements suffer from the need for thick coatings, slow coating speeds, the need for calendering to achieve appropriate surface properties, and the resulting haziness of transparent fills due to thickness.

Thus, it is towards providing a simple, inexpensive and readily implementable solution to the problem of meeting these diverse needs of an image-recording element adapted for use in such devices as ink-jet printers and pen plotters that the present invention is directed.

SUMMARY OF THE INVENTION

The present invention provides an image-recording element for an ink-jet printer comprising, in the following order:

(a) a substrate;

(b) a solvent-absorbing gelatin layer and (c) a single image-forming layer of porous, pseudo-boehmite having an average pore radius of 10 to 80 Å.

Images recorded on the elements of this invention exhibit (1) rapid ink dry times, (2) color images having high optical densities and a wide color gamut, (3) good waterfastness and (4) excellent offset and smudge resistance.

DESCRIPTION OF THE PREFERRED EMBODIMENTS

On the substrate, a gelatin layer capable of absorbing the solvent carrier in the ink is formed. The dry thickness of this layer is from 0.5 to 50 micrometers, preferably from 4 to 8 micrometers. If the thickness of the solvent-absorbing gelatin layer is less than 0.5 micrometer, adequate absorption of the solvent will not be obtained. If, on the other hand, the thickness of the solvent-absorbing gelatin layer exceeds 50 micrometers, no further increase in solvent absorptivity will be gained.

Gelatin—e.g., alkali-treated gelatin (cattle bone or hide gelatin) or acid-treated gelatin (pigskin gelatin), gelatin derivatives—e.g., acetylated gelatin, phthalate gelatin, and the like is suitable for forming the solvent-absorbing layer used in the image-recording elements of the present invention. Gelatin is particularly useful as the solvent-absorbing material because it is highly absorptive of the carrier liquid (typically water) contained in the inks.

If desired, the gelatin layer can be cross-linked in the image-recording elements of the present invention in order to impart mechanical strength to the layer. There are a vast number of known cross-linking agents—also known as hardening agents—that will function to cross-link the gelatin.

Hardening agents can be used individually or in combination and in free or blocked form. A great many useful hardeners are known including formaldehyde and free dialdehydes, such as succinaldehyde and glutaraldehyde.

A preferred cross-linking agent is a vinylsulfonyl compound. The vinylsulfonyl compound reacts with the amino and carboxyl groups which are present in gelatin to effect the cross-linking of the gelatin.

Vinylsulfonyl compounds are well known and particularly effective hardening agents—that is cross-linking agents—for gelatin. The vinylsulfonyl hardeners are characterized by the inclusion of a plurality of vinylsulfonyl groups. In perhaps the simplest possible structural form, divinylsulfone, a single sulfonyl group joins two vinyl groups. Most typically, a plurality of vinylsulfonylalkyl groups, such as vinylsulfonylmethyl, ethyl, propyl or butyl groups, are joined through an intermediate ether, amine, diamine or hydrocarbon linkage. Bis-(vinylsulfonyl)ethers such as bis(vinylsulfonylmethyl) and bis (vinylsulfonylethyl)ethers have been found to be particularly suitable for use as hardeners. Representative vinylsulfonyl hardeners as well as procedures for their synthesis and use are disclosed in Burness et al U.S. Pat. Nos. 3,490,911, issued Jan. 20, 1970; 3,539,644, issued Nov. 10, 1970 and 3,642,486, issued Feb. 15, 1972, the disclosures of which are incorporated herein by reference.

Illustrative examples of useful vinylsulfonyl hardeners include:

bis( vinylsulfonylmethyl)ether;

bis (2-vinylsulfonylethyl)ether;

bis(4-vinylsulfonylbutyl)ether;

N,N-bis(2-vinylsulfonylethyl)-n-propylamine;

N,N-bis(2-vinylsulfonylethyl)piperazine;

bis[2-(2-vinylsulfonylethoxy)ethyl]sulfone, and

N,N-bis[2-(2-vinylsulfonylethoxy)ethyl]urea.

The proportions of the ingredients making up the coating composition which forms the solvent-absorbing layer can be varied widely to meet the requirements of the particular element involved. Typically, the cross-linking agent which cross-links the gelatin is utilized in an amount of from about 0.1 to about 10% by weight of the gelatin, and more preferably in an amount of from 0.5% to about 7% by weight of the gelatin.

To form the solvent-absorbing layer, the gelatin and the cross-linking agent for the gelatin (if desired) are combined together in an aqueous solution or dispersion, coated as a thin layer on the support material and dried. The composition can be coated on the support material by any of a number of suitable procedures including bar coating, reverse roll coating, comma coating, gravure coating, dice coating, and the like. Drying of the coated layer can be carried out over a wide range of temperatures, for example, at temperatures of from about 40° C. to 140° C. Alternatively, the gelatin layer can be formed on the substrate by melt extruding the gelatin onto the substrate.

Typically, the solvent-absorbing gelatin material will cover the entire side of one surface of the substrate in the form of a separate and distinct layer. However, there may be instances where it is desirable that the solvent-absorbing material cover only a portion of the substrate such as, for example, where it is desired that the solvent-absorbing material adhere to the substrate in the form of one or more spots, patches, strips, bars or the like. In these instances, the pseudo-boehmite material may cover all of the substrate including the solvent-absorbing material or just the solvent-absorbing material itself depending upon the type of effect one wishes to create.

The solvent-absorbing gelatin layer used in the recording elements of the present invention also can incorporate various known additives, including matting agents such as titanium dioxide, zinc oxide, silica and polymeric beads such as crosslinked poly(methyl methacrylate) or polystyrene beads for the purposes of contributing to the non-blocking characteristics of the recording elements used in the present invention and to control the smudge resistance thereof; surfactants such as non-ionic, hydrocarbon or fluorocarbon surfactants or cationic surfactants, such as quaternary ammonium salts for the purpose of improving the aging behavior of the solvent-absorbing gelatin layer and enhancing the surface uniformity of the layer; pH controllers; preservatives; viscosity modifiers; dispersing agents; UV absorbing agents; antistatic agents, and the like. Such addenda can be selected from known compounds and materials in accordance with the objects to be achieved.

In the present invention, the recording media can be opaque, translucent or transparent. Thus, the substrates utilized in the recording media of the present invention are not particularly limited and various substrates may be employed. Accordingly, plain papers, resin-coated papers, various plastics including a polyester-type resin such as poly(ethylene terephthalate), poly(ethylene naphthalate) and polyester diacetate, a polycarbonate-type resin, a fluorine-type resin such as ETFE, metal foil, various glass materials, and the like can be employed as substrates. When the substrates of the present invention are transparent, a transparent recording element can be obtained and used as a transparency in an overhead projector.

The substrates employed in the present invention must be self-supporting. By "self-supporting" is meant a support material such as a sheet of film that is capable of independent existence in the absence of a supporting substrate.

The thickness of the substrate can be 25 to 500 μm, preferably 75 to 300 μm.

If desired, in order to improve the adhesion of the solvent-absorbing gelatin layer to the substrate, the surface of the substrate may be corona-discharge-treated prior to applying the solvent-absorbing layer to the substrate or, alternatively, an under-coating, such as a layer formed from a halogenated phenol or a partially hydrolyzed vinyl chloride-vinyl acetate copolymer can be applied to the surface of the substrate. If an under-coating or subbing layer is used, it should have a thickness (i.e., a dry coat thickness) of less than 2 micrometers.

Optionally, an additional backing layer or coating can be applied to the backside of the substrate (i.e., the side of the substrate opposite the side on which the solvent-absorbing gelatin layer and the porous, pseudo-boehmite layer are formed) for the purposes of improving the machine-handling properties of the recording element, controlling the friction and resistivity thereof, controlling curl, and the like. Typically, the backing layer may comprise a binder and a filler. Typical fillers include amorphous and crystalline silicas, poly(methyl methyacrylate), hollow sphere polystyrene beads, micro crystalline cellulose, zinc oxide, talc and the like. The filler loaded in the backing layer is generally less than 2 percent by weight of the binder component and the average particle size of the filler material is in the range of 5 to 15, preferably 5 to 10 micrometers. Typical of the binders used in the backing layer are polymers such as gelatin, chitosan, acrylates, methacrylates, polystyrenes, acrylamides, poly(vinyl alcohol), poly(vinyl pyrrolidone), poly(vinyl chloride)-poly(vinyl acetate) co-polymers, SBR latex, NBR latex, cellulose derivatives, and the like. Additionally, an antistatic agent also can be included in the backing layer to prevent static hindrance of the recording media. Particularly suitable antistatic agents are compounds such as dodecylbenzenesulfonate sodium salt, octylsulfonate potassium salt, oligostyrenesulfonate sodium salt, laurylsulfosuccinate sodium salt, and the like. The antistatic agent is added to the binder composition in an amount of 0.1 to 15 percent by weight, based on the weight of the binder.

In the present invention, a porous, pseudo-boehmite layer having an average pore radius of from 10 to 80 Å is formed as an upper layer over the lower solvent-absorbing gelatin layer. The dry thickness of the pseudo-boehmite layer ranges from 0.1 to 20 micrometers, preferably 0.5 to 5 micrometers. If the thickness of this layer is less than 0.1 micrometer, adequate absorptivity of the dye in the ink will not be obtained and image offset and smearing of the image may occur. On the other hand, if the thickness of the layer exceeds about 20 micrometers, the transparency of the recording medium likely will be impaired if the recording medium is transparent, for example, or if the recording medium is opaque, the recorded image will possess insufficient gloss.

Further, if the average pore radius of the pseudo-boehmite layer is less than 10 Å, no adequate absorptivity of the dye in the ink will be obtained and, if the average pore radius exceeds 80 Å, the transparency of the recording element is likely to be impaired if the recording element is transparent and the printed image will lack sufficient gloss if the recording element is opaque. The preferred average pore radius is from 15 to 60 Å. Pore size distribution is measured by a nitrogen adsorption and desorption method. Further, the layer of pseudo-boehmite has a pore volume is from 0.1 to 2.0 cc/g, preferably 0.15 to 0.65 from the viewpoint of ink absorptivity.

In the present invention, pseudo-boehmite is a xerogel of boehmite represented by the chemical formula AlOOH (alumoxane). Here, the pore characteristics when gelled vary depending upon the size and shape of colloid particles of boehmite. If pseudo-boehmite having a large particle size is used, image recording elements having a large average pore radius can be obtained.

Preferably, an organic binder component is employed in the porous, pseudo-boehmite layer to impart mechanical strength to the porous layer. When a binder is employed, the pore characteristics of the pseudo-boehmite layer will vary depending upon the type of the binder.

As the binder, it is usually possible to employ an organic material such as starch or one of its modified products, poly(vinyl alcohol) or one of its modified products, SBR latex, NBR latex, cellulose derivatives, quaternary salt polymers, etheric substituted poly(phosphazenes), etheric substituted acrylates, poly(vinyl pyrrolidone), or other suitable binders. The binder is used in an amount of from 5 to 75 percent by weight of the pseudo-boehmite, preferably in an amount of 5 to 50 percent by weight of the pseudo-boehmite. If the amount of binder is less than 5 percent by weight, the strength of the aluminum hydrate layer tends to be inadequate. On the other hand, if it exceeds 75 percent by weight, the waterfastness of the layer is adversely effected.

If desired, the porous, pseudo-boehmite image-loaning layer used in the recording elements of the present invention also can incorporate various known additives, including matting agents, surfactants, pH controllers, anti-foaming agents, lubricants, preservatives, viscosity modifiers, waterproofing agents, dispersing agents, UV absorbing agents, mildew-proofing agents, mordants, antistatic agents, and the like.

As a method of forming the pseudo-boehmite layer on the solvent-absorbing lower layer, it is possible to employ, for example, a method wherein a binder is added to a boehmite so to obtain a slurry and the slurry is coated over the solvent-absorbent lower layer by means of a roll coater, an air knife coater, a blade coater, a rod coater, a bar coater, a comma coater, or the like, and dried. A preferred example of a coating composition is a 1:1 to 9:1 weigh ratio mixture of pseudo-boehmite and poly(vinyl pyrrolidone).

In the present invention, when the ink is ejected from the nozzle of the ink-jet printer in the form of individual droplets, the droplets pass through the upper layer of porous, pseudo-boehmite where most of the dyes in the ink are retained or mordanted in the pseudo-boehmite layer while the remaining dyes and the solvent or carrier portion of the ink pass freely through the pseudo-boehmite layer to the underlying solvent-absorbing layer where they are rapidly absorbed by the layer of gelatin. In this manner, large volumes of ink are quickly absorbed by the recording elements of the present invention giving rise to high quality recorded images having excellent optical density, excellent resolution, good drying times, excellent waterfastness, excellent image-banding resistance, excellent puddling resistance and excellent bleed resistance. This is in contrast to recording elements comprising a substrate and a layer of either gelatin or pseudo-boehmite alone which exhibit poor waterfastness, slow drying times and recorded images.

If desired, the recording elements of the present invention can have the pseudo-boehmite layer overcoated with an ink-permeable, anti-tack protective layer, such as, for example, a layer comprising a cellulose derivative such as hydroxymethyl cellulose, hydroxyethyl cellulose, hydroxypropyl methyl cellulose and carboxymethyl cellulose. An especially preferred topcoat is hydroxypropyl methyl cellulose. Such cellulosic resins are commercially available. For example, hydroxypropyl methyl cellulose can be obtained from Dow Chemical Corporation under the tradename Methocel™. The topcoat layer is non-porous, but is ink-permeable and serves to improve the optical density of the images printed on the element with water-based inks. The topcoat layer also serves to protect the porous, pseudo-boehmite layer from abrasion, smudging and water damage.

The topcoat material preferably is coated onto the pseudo-boehmite layer from water or water-alcohol solutions at a dry thickness ranging from 0.1 to 5.0 micrometers, preferably 0.5 to 2.0 micrometers. The topcoat layer may be coated in a separate operation or may be coated concurrently with the pseudo-boehmite layer using a multi-slot hopper or a slide-hopper.

In practice, various additives may be employed in the topcoat. These additives include surface active agents which control the wetting or spreading action of the coating mixture, anti-static agents, suspending agents, particulates which control the frictional properties or act as spacers for the coated product, antioxidants, UV-stabilizers and the like.

The inks used to image the recording elements used in the present invention are well-known inks. The ink compositions used in ink-jet printing typically are liquid compositions comprising a solvent or carrier liquid, dyes or pigments, humectants, organic solvents, detergents, thickeners, preservatives, and the like. The solvent or carrier liquid can be comprised solely of water or can be predominately water mixed with other water-miscible solvents such as polyhydric alcohols, although inks in which organic materials such as polyhydric alcohols are the predominant carrier or solvent liquid also may be used. Particularly useful are mixed solvents of water and polyhdric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758.

Although the recording elements disclosed herein have been referred to primarily as being useful for ink-jet printers, they also can be used as recording media for pen plotter assemblies. Pen plotters operate by writing directly on the surface of a recording medium using a pen consisting of a bundle of capillary tubes in contact with an ink reservoir.

The invention is further illustrated by reference to the following Examples. However, it should be understood that the present invention is by no means restricted to such specific Examples.

EXAMPLE 1

A 5-L, 3-neck Morton type flask fitted with a mechanical stirrer and a condenser was charged with isopropanol (764 mL) and water (2160 mL). The mixture was stirred (250 rpm) at reflux (81° C.) and aluminum isopropoxide (615 g, 3 mol) was added over a 45 min period. The reflux continued for 5 hours then 18 mL of acetic acid (0.31 moles) was added dropwise over a 15 min period. The stirred reaction mixture was maintained at reflux for 42 hours, then 1280 mL of solvent was distilled. The reaction was allowed to cool overnight and filtered to yield an pseudo-boehmite slurry containing about 10% solids.

Onto resin coated paper that was about 163 μm thick was coated by means of an extrusion hopper a solution consisting of 11 g of dry gelatin (about 90% solids), 4.9 g of a 2% solution in water of BVSME hardener (bis (vinylsulfonylmethyl)ether obtained from Eastman Kodak, 0.1 g of a 20% solution in water of nonylphenoxypolyglycidol obtained as Surfactant 10G from Olin Corporation, and 84 g of water at a dry laydown coverage of about 0.6 gm/ft$^2$.

A dispersion prepared by mixing 24.3 g of the pseudo-boehmite slurry above, 24.3 g of a 10% solution in water of poly(vinylpyrrolidone) (PVP K-90, ISP Technologies, Inc.), 6.1 g of 1N nitric acid, 0.2 g of a 20% solution in water of nonylphenoxypolyglycidol obtained as Surfactant 10G from Olin Corporation and 45.1 g of water was coated over the gelatin layer by means of an extrusion hopper and dried to form a porous layer of pseudo-boehmite having a dry laydown coverage of about 0.2 gm/ft$^2$.

COMPARATIVE EXAMPLE 1A

A dispersion prepared by mixing 47 g of pseudo-boehmite slurry described in Example 1, 47 g of a 10% solution in water of poly(vinylpyrrolidone) (PVP K-90, ISP Technologies, Inc.), 6.1 g of 1N nitric acid, and 0.2 g of a 20% solution in water of nonylphenoxypolyglycidol obtained as Surfactant 10G from Olin Corporation was coated on one side of a resin coated paper that was about 163 μm thick by means of an extrusion hopper in an amount sufficient to form a porous layer of pseudo-boehmite so that the dry laydown coverage would be about 0.8 gm/ft$^2$.

EXAMPLE 2

A 5-L, 3-neck Morton type flask fitted with a mechanical stirrer and a condenser was charged with isopropanol (764 mL) and water (2160 mL). The mixture was stirred (250 rpm) at reflux (81° C.) and aluminum isopropoxide (615 g, 3 mol) was added over a 45 min period. The reflux continued for 5 hours then 19.5 mL of 70.5% nitric acid (0.32 moles) was added dropwise over a 15 min period. The stirred reaction mixture was maintained at reflux for 42 hours, and then 1280 mL of solvent was distilled. The reaction was allowed to cool overnight and filtered to yield an pseudo-boehmite slurry containing about 10% solids.

Onto resin coated paper that was about 163 μm thick was coated by means of an extrusion hopper a solution consisting of 11 g of dry gelatin (about 90% solids), 4.9 g of a 2% solution in water of BVSME hardener (bis (vinylsulfonylmethyl)ether obtained from Eastman Kodak, 0.1 g of a 20% solution in water of nonylphenoxypolyglycidol obtained as Surfactant 10G from Olin Corporation, and 84 g of water at a dry laydown coverage of about 0.6 gm/ft$^2$.

A dispersion prepared by mixing 37.3 g of the pseudo-boehmite slurry above, 37.3 g of a 10% solution in water of poly(vinylpyrrolidone) (PVP K-90, ISP Technologies, Inc.), 6.1 g of 1N nitric acid, 0.2 g of a 20% solution in water of nonylphenoxypolyglycidol obtained as Surfactant 10G from Olin Corporation and 19.1 g of water was coated over the gelatin layer by means of an extrusion hopper and dried to form a porous layer of pseudo-boehmite having a dry laydown coverage of about 0.2 gm/ft$^2$.

COMPARATIVE EXAMPLE 2A

A dispersion prepared by mixing 47 g of pseudo-boehmite slurry described in Example 2, 47 g of a 10% solution in water of poly(vinylpyrrolidone) (PVP K-90, ISP Technologies, Inc.), 6.1 g of 1N nitric acid, and 0.2 g of a 20% solution in water of nonylphenoxypolyglycidol obtained as Surfactant 10G from Olin Corporation was coated on one side of a resin coated paper that was about 163 μm thick by means of an extrusion hopper in an amount sufficient to form a porous layer of pseudo-boehmite so that the dry laydown coverage would be about 0.8 gm/ft$^2$.

EXAMPLE 3

A 3-L, 3-neck Morton type flask fitted with a mechanical stirrer and a condenser was charged with water (1500 mL). Aluminum isopropoxide (306 g, 1.5 mol) was added over 45 minutes and the reaction mixture was refluxed for 5 hours. 9.85 mL of 70.5% nitric acid (0.16 moles) was then added dropwise over a 15 min period. The mixture was stirred at reflux for 48 hrs. then 640 mL of solvent was distilled. The reaction was allowed to cool overnight and filtered to yield an pseudo-boehmite slurry containing about 11.3% solids.

Onto resin coated paper that was about 163 μm thick was coated by means of an extrusion hopper a solution consisting of 11 g of dry gelatin (about 90% solids), 4.9 g of a 2% solution in water of BVSME hardener (bis (vinylsulfonylmethyl)ether obtained from Eastman Kodak, and 0.1 g of a 20% solution in water of nonylphenoxypolyglycidol obtained as Surfactant 10G from Olin Corporation, and 84 g of water at a dry laydown coverage of about 0.6 gm/ft$^2$.

A dispersion prepared by mixing 22 g of the pseudo-boehmite slurry above, 24.8 g of a 10% solution of poly (vinylpyrrolidone) (PVP K-90, ISP Technologies, Inc.), 6.1 g of 1N nitric acid, 0.2 g of a 20% solution in water of nonylphenoxypolyglycidol obtained as Surfactant 10G from Olin Corporation and 46.9 g of water was coated over the gelatin layer by means of an extrusion hopper and dried to form a porous layer of pseudo-boehmite having a dry laydown coverage of about 0.2 gm/ft$^2$.

COMPARATIVE EXAMPLE 3A

A dispersion prepared by mixing 44 g of pseudo-boehmite slurry described in Example 3, 49.7 g of a 10% solution in water of poly(vinylpyrrolidone) (PVP K-90, ISP Technologies, Inc.), 6.1 g of 1N nitric acid, and 0.2 g of a 20% solution in water of nonylphenoxypolyglycidol obtained as Surfactant 10G from Olin Corporation was coated on one side of a resin coated paper that was about 163 μm thick by means of an extrusion hopper in an amount sufficient to form a porous layer of pseudo-boehmite so that the dry laydown coverage would be about 0.8 gm/ft$^2$.

EXAMPLE 4

Onto resin coated paper that was about 163 μm thick was coated by means of an extrusion hopper a solution consisting of 11 g of dry gelatin (about 90% solids), 4.9 g of a 2% solution in water of BVSME hardener (bis (vinylsulfonylmethyl)ether obtained from Eastman Kodak, and 0.1 g of a 20% solution in water of nonylphenoxypolyglycidol obtained as Surfactant 10G from Olin Matheson Company, and 84 g of water at a dry laydown coverage of about 0.6 gm/ft$^2$.

A dispersion prepared by mixing 9.9 g of a porous, pseudo-boehmite slurry obtained from Vista Chemical Company under the tradename of Dispal™ 23N4-20, 24.8 g of a 10% solution in water of poly(vinypyrrolidone) (PVP K-90, ISP Technologies, Inc.), 6.1 g of 1N nitric acid, 0.2 g of a 20% solution in water of nonylphenoxypolyglycidol obtained as Surfactant 10G from Olin Corporation, and 59 g of water was coated over the gelatin layer by means of an extrusion hopper and dried to form a porous layer of pseudo-boehmite having a dry laydown coverage of about 0.2 gm/ft$^2$.

COMPARATIVE EXAMPLE 4A

A dispersion prepared by mixing 20 g of a porous, pseudo-boehmite slurry obtained from Vista Chemical Company under the tradename of Dispal™ 23N4-20, 50 g of a 10% solution in water of poly(vinylpyrrolidone) (PVP K-90, ISP Technologies, Inc.), 6.1 g of 1N nitric acid, 0.2 g of a 20% solution in water of nonylphenoxypolyglycidol obtained as Surfactant 10G from Olin Corporation, and 23.7 g of water was coated on one side of a resin coated paper that was about 163 μm thick by means of an extrusion hopper in an amount sufficient to form a porous layer of pseudo-boehmite so that the dry laydown coverage would be about 0.8 gm/ft$^2$.

COMPARATIVE EXAMPLE 5A

Onto resin coated paper that was about 163 μm thick was coated by means of an extrusion hopper a solution consisting of 11 g of dry gelatin (about 90% solids), 4.9 g of a 2% solution in water of BVSME hardener (bis (vinylsulfonylmethyl)ether obtained from Eastman Kodak, and 0.1 g of a 20% solution in water of nonylphenoxypolyglycidol obtained as Surfactant 10G from Olin Corporation, and 84 g of water at a dry laydown coverage of about 0.8 gm/ft$^2$.

Examples 1–4, and comparative examples 1A–5A, were imaged with a Hewlett-Packard Desk Writer 560C 4-color ink jet printer using a test pattern consisting of 2.4 cm×2.4 cm dye patches of black and each of the three primary colors cyan, magenta, and yellow and each of the three secondary colors, red, green, and blue, 2.4 cm×2.4 cm dye patches consisting of a series of horizontal and vertical black bars surrounded by each of the three primary colors and reference bars with no surrounding color, and 3.6 cm×1.2 cm dye patches of black and each of the three primary colors. The 3.6 cm×1.2 cm black, yellow, magenta, and cyan patches were measured to determine the variation in the time needed for the above recording elements to dry after they were generated in a HP560C printer. The test for dry time utilizes 8.5"×11" ink jet sheets printed at 80% RH, 70° F. The black, cyan, magenta, and yellow 3.6 cm×1.2 cm dye patches are located on the test target such that they are the last area to be printed before the sheet is ejected from the printer. As soon as the printed sheet is ejected into the receiver tray, a stopwatch is stared and the sheet is removed from the tray and placed on a hard white surface. The tip of a fresh cotton swab is firmly pressed on each of the black, cyan, magenta, and yellow patches and then lifted. The tip of the swab is checked for color. If the swab does not stick and no color is observed on the swab then the dry lime is noted for that color patch. If sticking or color on the tip are observed then a fresh area on the same color patch is tested again after the indicated interval in seconds (30, 60, 90, 120, 150, 210, 240, 270, 300, 330, 360).

| | Dry Times (minutes) | | | |
|---|---|---|---|---|
| Sample | Black | Yellow | Cyan | Magenta |
| Example 1 | 7.0 | 0.5 | 3.0 | 3.0 |
| Comparative Example 1A | 8.0 | 5.0 | 4.5 | 4.5 |
| Example 2 | 6.5 | 0.5 | 1.0 | 1.5 |
| Comparative Example 2A | 7.5 | 2.5 | 5.0 | 5.0 |
| Example 3 | 1.0 | 1.0 | 1.0 | 1.0 |
| Comparative Example 3A | 7.5 | 4.0 | 4.0 | 4.0 |
| Example 4 | 8.5 | 5.0 | 5.0 | 5.0 |
| Comparative Ex. 4A | >10 | 9.5 | 9.5 | 9.0 |
| Comparative Example 5A | >10 | 5.5 | 6.5 | 6.5 |

The test prints were visually inspected for cracking, and, bronzing. For the purposes of this analysis, cracking is physical cracks in the coating, and bronzing is the appearance of a brown or "bronze" color when the black patch is viewed with reflected light. The examples were rated on a scale of 1 to 4 for cracking (1 is best) and Yes, No for bronzing ("No" indicates no bronzing, "Yes" indicates bronzing). Below are the results of the analysis.

| Sample | Cracking | Bronzing |
|---|---|---|
| Example 1 | 1 | No |
| Comparative Example 1A | 3 | Yes |
| Example 2 | 1 | No |
| Comparative Example 2A | 4 | Yes |
| Example 3 | 1 | Yes |
| Comparative Example 3A | 3 | Yes |
| Example 4 | 1 | No |
| Comparative Ex. 4A | 3 | Yes |
| Comparative Example 5A | 1 | No |

These results show that the image-recording elements of the present invention, when imaged with an ink-jet printing device, have better overall performance than any of the comparative, prior-art elements.

Although the invention has been described in detail with particular reference to preferred embodiments for the purpose of illustration, it is to be understood that such detail is solely for that purpose, and that variations and modifications can be made by those skilled in the art without departing from the spirit and scope of the invention.

What is claimed:

1. An image-recording element for an ink-jet printer consisting of, in the following order:

(a) a substrate;

(b) a solvent-absorbing gelatin layer and (c) a single image-forming layer of porous, pseudo-boehmite having an average pore radius of 10 to 80 Å.

2. The image-recording element of claim 1, wherein the porous, pseudo-boehmite layer has an average pore radius of 15 to 60 Å.

3. The image-recording element of claim 1, wherein the porous, pseudo-boehmite layer has a pore volume of 0.1 to 2.0 cc/g.

4. The image-recording element of claim 1, wherein the gelatin layer is cross-linked by a vinylsulfonyl compound.

5. The image-recording element of claim 4, wherein the gelatin is cross-linked by bis(vinylsulfonylmethyl)ether.

6. The image-recording element of claim 1, wherein the thickness of the substrate is 50 to 500 micrometers.

7. The image-recording element of claim 1, wherein the dry thickness of the porous, pseudo-boehmite layer is from 0.1 to 20 micrometers.

8. The image-recording element of claim 1, wherein the dry thickness of the solvent-absorbing gelatin layer is 0.5 to 50 micrometers.

9. The image-recording element of claim 1, wherein the substrate is transparent.

10. The image-recording element of claim 9, wherein the substrate is poly(ethylene terephthalate).

11. The image-recording element of claim 9, wherein the substrate is poly(ethylene naphthalate).

12. The image-recording element of claim 1, wherein the substrate is opaque.

* * * * *